US006523510B2

(12) United States Patent
Asanomi et al.

(10) Patent No.: US 6,523,510 B2
(45) Date of Patent: Feb. 25, 2003

(54) VALVE DRIVE MECHANISM FOR ENGINE

(75) Inventors: Kouji Asanomi, Hiroshima (JP); Hirokazu Matsuura, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 2 days.

(21) Appl. No.: 09/927,600

(22) Filed: Aug. 10, 2001

(65) Prior Publication Data

US 2002/0020378 A1 Feb. 21, 2002

(30) Foreign Application Priority Data

Aug. 11, 2000 (JP) ..... 2000-245021

(51) Int. Cl.[7] ..... F01L 1/34

(52) U.S. Cl. ..... 123/90.16; 123/90.27; 123/90.48; 123/90.57

(58) Field of Search ..... 123/90.27, 90.48, 123/90.49, 90.52, 90.56, 90.57, 90.15, 90.16, 90.17

(56) References Cited

U.S. PATENT DOCUMENTS 5,090,364 A 2/1992 McCarroll et al.
6,032,624 A * 3/2000 Tsuruta et al. ..... 123/90.16
6,125,804 A * 10/2000 Kawai et al. ..... 123/90.16

FOREIGN PATENT DOCUMENTS

JP 3-46642 7/1991
JP 05-086823 4/1993

* cited by examiner

*Primary Examiner*—Thomas Denion
*Assistant Examiner*—Jaime Corrigan
(74) *Attorney, Agent, or Firm*—Brooks & Kushman, P.C.

(57) ABSTRACT

A valve drive mechanism includes a tappet assembly which comprises a center tappet, a pair of side tappets between which the center tappet is interposed so as to move relatively to the side tappets, and a locking/unlocking mechanism operative to mechanically couple the center tappet to both of the side tappets and to uncouple the center tappet from both of the side tappets so as to selectively transmit rotation of a high lift center cam and low lift side cams to twin valves such as twin intake valves and twin exhaust valves per cylinder. Locking/unlocking of the center tappet and each side tappet is performed in a position which is in a vertical plane including a center axis of each side tappet and intersecting perpendicularly to an axial direction of a camshaft and is offset from the center axis of the side tappet.

20 Claims, 10 Drawing Sheets

VALVE DRIVE MECHANISM FOR ENGINE

BACKGROUND OF THE INVENTION

1. Field of the Invention

The present invention relates to a valve drive mechanism for an engine which is variable in valve lift and has a valve lifter or tappet which selectively transmits rotation of different lift cams.

2. Description of Related Art

There has been known various valve drive mechanisms which can drive valves with variable valve lifts. For example in Japanese Unexamined Patent Publication No. 3-46642 a valve drive mechanism in which a valve lift is variable. This valve drive mechanism for an engine equipped with twin intake valves and twin exhaust valves per cylinder has a tappet assembly which comprises a center tappet and a pair of side tappets arranged such that the center tappet is interposed between the side tappets. The tappet assembly further comprises locking/unlocking pins operative to lock or couple the center tappet to the side tappets, respectively, so as to force the center tappet and the side tappets to move up and down as one whole or unlock or uncouple the center tappet from the side tappets so as to allow the center tappet to move up and down relatively to the side tappets, thereby selectively transmitting rotation of a high lift center cam and low lift side cams to the twin valves, in other words, driving the twin valves with a variable valve lift.

The prior art valve drive mechanism couples and uncouples these center and side tappets in locking/unlocking positions each of which is on a line passing vertical center axes of the side tappets but offset toward a vertical center axis of the center tappet from the vertical center axes of the side tappets, respectively, in an axial direction of a camshaft. This possibly causes an inclination of each side tappet toward the center tappet while the center tappet and the side tappet coupled together is driven as one whole by the high lift center cam, which is one of causes of undesirable wear on the side tappet and a guide tappet guide. In addition, the tappet assembly is apt to cause a relative inclination between the center tappet and the side tappet because it employs a single locking/unlocking pin in order to couple center tappet to each side tappet. This is another one of causes of undesirable wear on the side tappet and the tappet guide. The center tappet has a circular tappet head which provides only a short length of slide contact with the center cam, so that the center tappet is subjected to a great pressure on the tappet head. This results in wear on the tappet head of the center tappet.

SUMMARY OF THE INVENTION

It is therefore an object of the present invention to provide a valve drive mechanism which provides a center tappet head with a long length of slide contact with a center cam.

It is another object of the present invention to provide a valve drive mechanism which prevents an inclination of side tappets due to integral up and down movement while the center and side tappets are operated as one whole by a high lift cam so as thereby to prevent undesirable wear on the tappets and a tappet guide.

The above objects of the present invention are accomplished by a valve drive mechanism for an engine having twin intake valves and twin exhaust valves per cylinder for driving each twin valves with variable valve lift by one center cam, preferably a high lift cam, on a camshaft, namely an intake camshaft or an exhaust camshaft, and a pair of side cams, preferably low lift cams, on the camshaft that are arranged on opposite sides of the center cam in an axial direction of the camshaft and different in cam profile from the center cam. The valve drive mechanism comprises one center tappet operative to transmit rotation of the high center cam as reciprocating movement to said valve, a pair of side tappets, between which the center tappet is interposed so as to be movable relatively to the side tappets in a direction of valve lift by a tappet spring and the center cam alternatively, operative to transmit rotation of the low lift side comes as reciprocating movement to the valves through valve stems, respectively, and a locking/unlocking mechanism operative to mechanically couple and uncouple the center tappet and the side tappets in locking/unlocking positions each of which is in a vertical plane including a substantial vertical center axis of each of the side tappets and intersecting perpendicularly to the axial direction of the camshaft so as thereby to selectively transmit the rotation of the high lift center cam and the low lift side cams as reciprocal movement to the valves, respectively. The center tappet preferably has a generally rectangular tappet head. In this connection, the locking/unlocking mechanism is disposed on each of opposite sides of a line passing the substantial vertical center axes of the side tappets in a rotational direction of camshaft and offset from the line in a rotational direction of the cams.

Each side tappet preferably has a generally cylindrical hollow shell formed with a rectangular opening. These side tappets are disposed side by side at a specified distance from each other in the axial direction of camshaft such that the openings face each other in the axial direction of camshaft. The center tappet is disposed between the side tappets such as to be received in the rectangular openings.

The valve drive mechanism may further comprise a pair of guide rods disposed in the side tappets, respectively, by which the center tappet is supported for slide movement. These guide rods are preferably coaxial with the vertical center axes of the side tappets, respectively.

The locking/unlocking mechanism comprises a locking/unlocking pin disposed in the center tappet, a hydraulically operated locking plunger disposed in one of the side tappets so as to abuts against one end of the locking/unlocking pin, and a spring loaded unlocking receiver disposed in another one of the side tappets so as to abut against another end of the locking/unlocking pin. Specifically, the locking/unlocking pin is movably received in a center guide bore which is formed in the center tappet so as to extend along a line offset from the line passing the substantial vertical center axes of the side tappets in the rotational direction of camshaft and parallel to the axial direction of camshaft between the vertical planes. The hydraulically operated locking plunger is movably received in a first guide bore which is formed in alignment with the center guide bore in the one side tappet. The spring loaded unlocking receiver is movably received in a second guide bore which is formed in alignment with the center guide bore in the other side tappet. The locking/unlocking pin is forced to partly enter the second guide bore by the hydraulically operated locking plunger when the hydraulically operated locking plunger is forced by hydraulic oil to partly enter the center guide bore, so as to mechanically couple the center tappet to the side tappets. On the other hand, the locking/unlocking pin is forced by the spring loaded unlocking receiver to come out of the second guide bore and to return the hydraulically operated locking plunger into the first guide bore when the hydraulically operated locking plunger is released from the hydraulic oil.

The locking/unlocking mechanism further comprises a hydraulic oil path arrangement for introducing hydraulic oil from an oil gallery in the cylinder head to the first guide bore so as to apply hydraulic pressure on the hydraulically operated locking plunger.

Specifically, the hydraulic oil path arrangement comprises an oil channel formed in the one side tappet through which the hydraulic oil is introduced into the first guide bore, more preferably into an oil chamber that may be formed at one of opposite ends of the first guide bore in the one side tappet and extend coaxially with the first guide bore from the first guide bore to an outer wall of the one side tappet. The hydraulic oil path arrangement may further comprises an oil channel formed in the one side tappet through which hydraulic oil is introduced into the oil chamber. The oil channel may be communicate with an oil gallery formed in parallel to camshaft in the cylinder head by a branch oil channel that is formed in the tappet guide. The branch oil channel partly opens to a tappet guide bore of the tappet guide in which the one side tappet is received so as to communicate the tappet guide bore with the branch oil passage.

The hydraulic oil path arrangement may further comprise a vertical oil channel formed in the one side tappet so as to communicate both the oil channels of the locking/unlocking mechanisms, The vertical oil channel preferably has a length in the direction of valve lift sufficient to keep communication of both oil channels of the locking/unlocking mechanisms with the branch oil channel while the tappet assembly reciprocally moves in the direction of valve lift.

According to the valve drive mechanism equipped with the tappet assembly in which locking/unlocking is performed in a position which is in a vertical plane including a substantial center axis of the side tappet and intersecting perpendicularly to the axial direction of camshaft, an inclination of the side tappets is prevented or significantly reduced during integral up and down movement of the center tappet and the side tappets operated as one whole by the high lift cam. Further, according to the valve drive mechanism equipped with the tappet assembly in which the center tappet is supported for slide movement by the pair of guide rods disposed preferably coaxially with the vertical center axes of the side tappets, respectively, an inclination of the side tappets with respect to the center tappet is prevented or significantly reduced during movement of the center tappet relative to the side tappets while the center tappet is driven independently from the side tappets by the high lift cam. As a result, the side tappets and the guide tappet guide are prevented from undesirable wear.

The configuration of the center tappet head that is generally rectangular provides the center tappet with a long length of slide contact with the center cam and, in addition, enables disposing the locking/unlocking mechanism on each of opposite sides of the axial direction of camshaft. The locking/unlocking mechanisms are offset from the line passing the vertical center axes of the side tappets in the rotational direction of cams and disposed on opposite sides of the axial direction of camshaft, so that the tappets are prevented from inclining in the rotational direction of cams. This guarantees the tappets to move up and down precisely in the direction of valve lift.

The locking/unlocking mechanism comprises the locking/unlocking pin moveably received in the center guide bore of the center tappet, the hydraulically operated locking plunger slidably received in the first guide bore of the one side tappets so as to abuts against one of the opposite ends of the locking/unlocking pin, and the spring loaded unlocking receiver slidably received in the second bore of the other side tappets so as to abut against another end of the locking/unlocking pin. The first guide bore is formed with an oil chamber into which hydraulic oil introduced so as to force the hydraulically operated plunger in the first guide bore. The locking/unlocking mechanism operates such that the locking/unlocking pin is forced to partly enter the second guide bore by the hydraulically operated locking plunger when the hydraulically operated locking plunger is forced by hydraulic oil to partly enter the center guide bore, so as to mechanically couple the center tappet to the side tappets and, on the other hand, the locking/unlocking pin is forced by the spring loaded unlocking receiver to come out of the second guide bore and to return the hydraulically operated locking plunger into the first guide bore when the hydraulically operated locking plunger is released from the hydraulic oil.

According to the valve drive mechanism equipped with the locking/unlocking mechanism thus structured, the locking/unlocking pin is reliably actuated for locking operation by hydraulic oil that an oil pump provides at a high pressure while the engine operates at a high speed.

The center tappet having a generally rectangular tappet head is disposed between the rectangular openings formed in the generally cylindrically shaped shells of the side tappets. This configuration of the tappet assembly can provides the center tappet with a long length of slide contact with the center cam having a high lift for high speed operation. Further, each low lift side cam that is more frequently used than the high lift center cam rides on the side tappet at a position in alignment with the valve stem. This prevents or significantly reduces an inclination of the tappets due to an offset of the valve stem from the contact point of the low rift side cam with the tappet.

BRIEF DESCRIPTION OF DRAWINGS

The foregoing and other objects and features of the present invention will become more apparent from the following description in connection with the preferred embodiments thereof when considering in conjunction with the accompanying drawings, in which the same reference numerals have been used to denote same or similar parts throughout the accompanying drawings, and wherein.

DETAILED DESCRIPTION OF THE INVENTION

Figure 1:
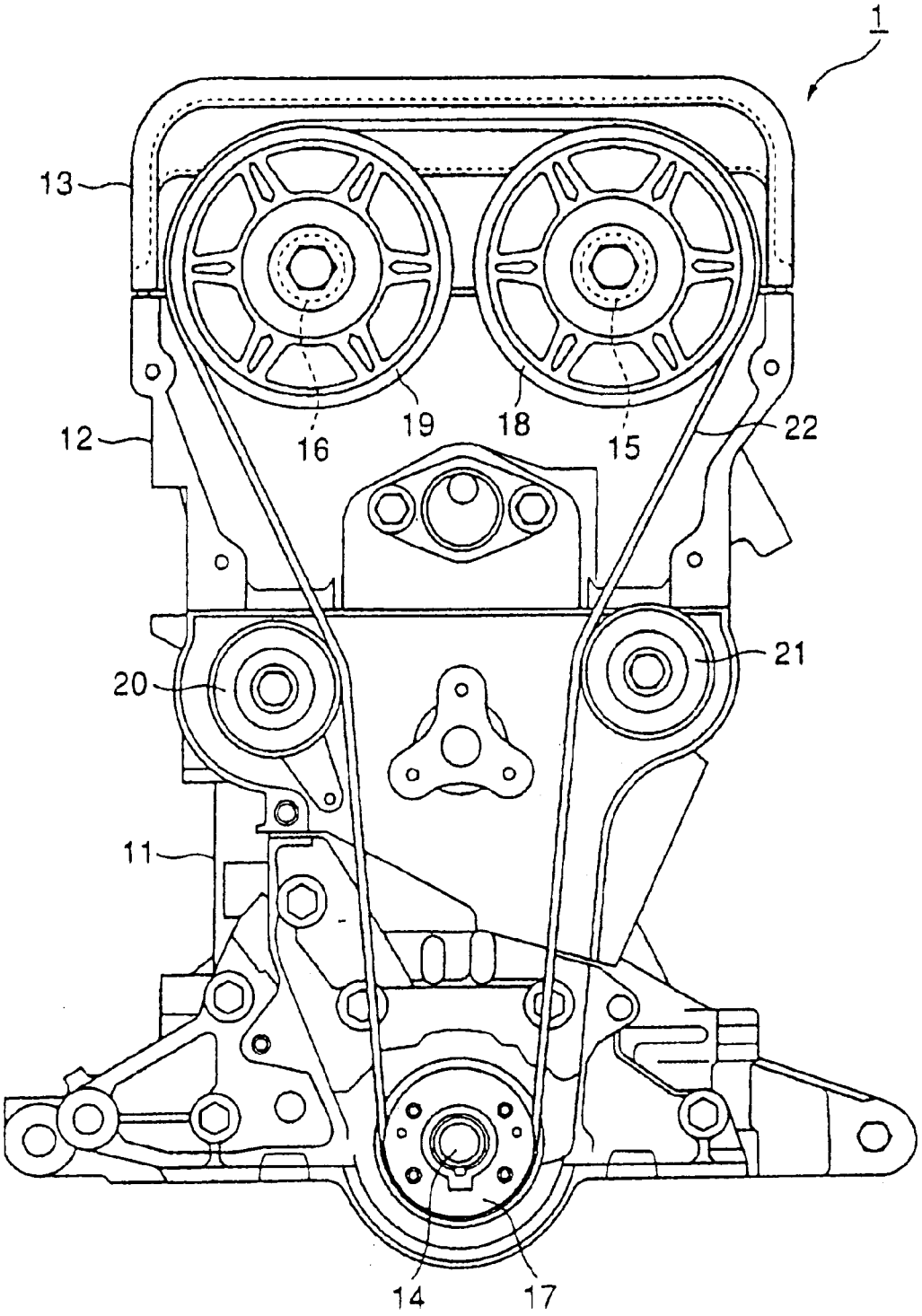
FIG. 1 is an end view of an engine equipped with a valve drive mechanism in accordance with n embodiment of the present invention.

Referring to the drawings in detail, and in particular to FIG. 1 which shows an internal combustion engine 1 equipped with a valve drive mechanism according to the present invention, the engine 1, which is of an in-line four cylinder type that has double overhead camshafts, is mounted in an engine compartment such that the camshafts extend in a transverse direction of the engine compartment. An engine body of the engine 1 comprises a cylinder block 11, a cylinder head 12 and a head cover 13. A crankshaft 14 is disposed at the bottom of the cylinder block 1 and axially extends beyond a front end of the cylinder block 11. Camshafts, namely an intake camshaft 15 and an exhaust camshaft 16, are disposed over the cylinder head 12 and axially extend beyond the front end of the cylinder head 12. The crankshaft 14 is provided with a crankshaft pulley 17 secure to one of its opposite ends that is beyond the front end of the cylinder head 12. The intake camshaft 15 is provided with a camshaft pulley 18 secure to one of its opposite ends that is beyond the front end of the cylinder head 12. Similarly, the exhaust camshaft 16 is provided with a camshaft pulley 19 secure to one of its opposite ends that is beyond the front end of the cylinder head 12. The cylinder block 11 is provided with a tension pulley 20 and an idle pulley 21 pivotally mounted to the front end thereof The intake camshaft 15 and the exhaust camshaft 16 are turned by a timing belt 22. The tension pulley 20 is adjustable in position so as to apply desired tension to the timing belt 22. The camshafts 15 and 16 turn one-half crankshaft speed.

Figure 2:
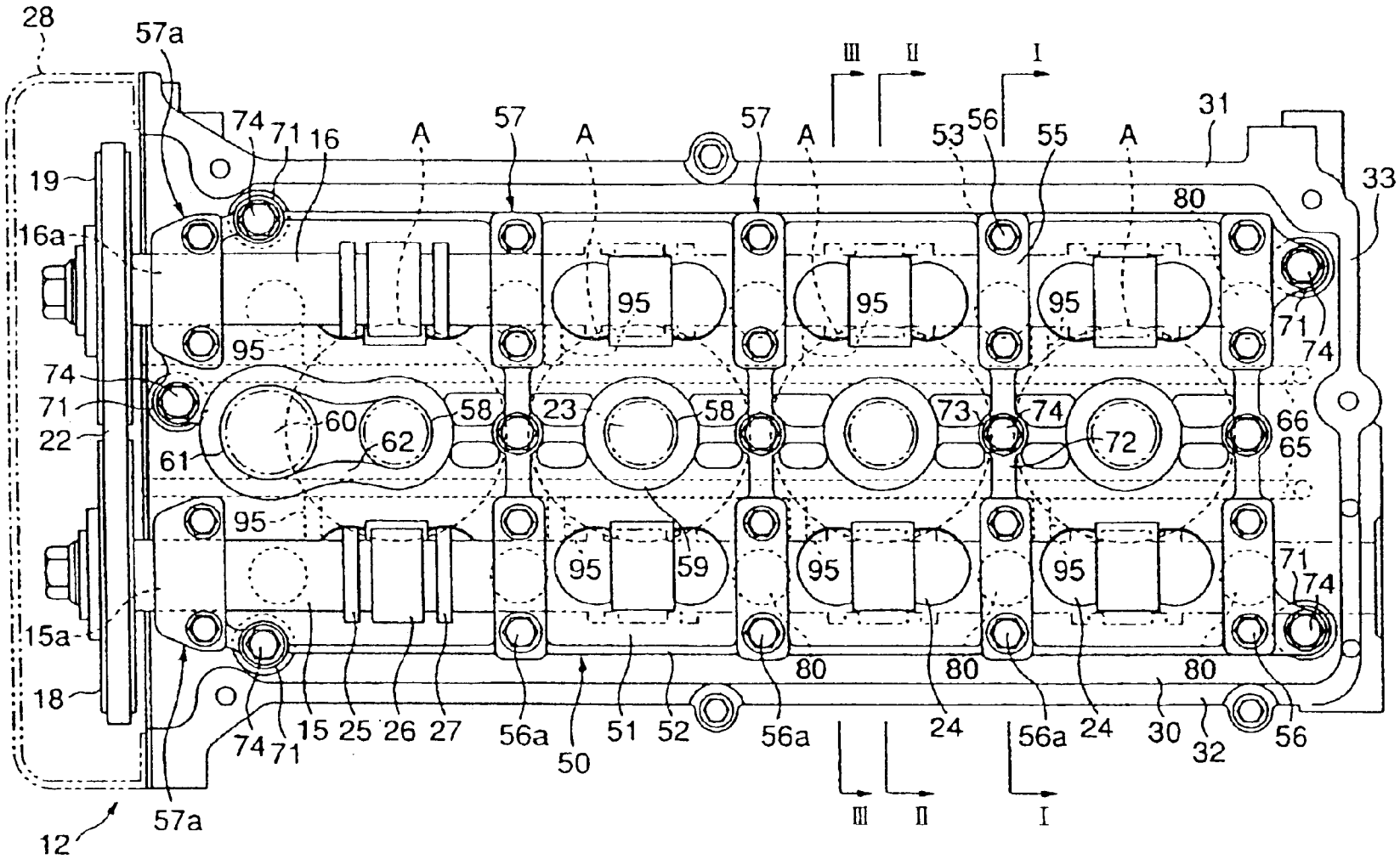
FIG. 2 is a top view of the engine with a cylinder head cover removed.

FIGS. 2 to 5 show a top of the cylinder head 12, a vertical cross-section of the cylinder head 12 as viewed along line III—III of FIG. 2, a vertical cross-section of the cylinder head 12 as viewed along line IV—IV of FIG. 2, and a vertical cross-section of the cylinder head 12 as viewed along line V—V of FIG. 2, respectively. As shown, the camshafts 15 and 16 extend in parallel with each other in the transverse direction. There is one spark plug 23 on the cylinder head 12 for each cylinder 2 in the engine 1. The engine 1 has four valves, namely two intake valves 39 and two exhaust valves 40, per cylinder. The two intake valves 39 are simultaneously driven by side cams 25 and 27 of the intake camshaft 15. Similarly, the two exhaust valves 40 are simultaneously driven by side cams 25 and 27 of the exhaust camshaft 16. These valves 39 and 40 are driven at appropriate timings by the camshafts 15 and 16 to open and close intake ports 34 and exhaust ports 35, respectively. The valve train includes a valve lifter or tappet assembly 24 installed between a cam lobe of the camshaft 15, 16 and a valve stem 81 of the valve 39, 40. The upper end of the tappet assembly 24 is in contact with the cam lobe and slid up and down when the camshaft 15, 16 turns.

The intake camshaft 15 has two low lift side cams 25 and 27 and one high lift center cam 26 for each intake valve 39. Similarly, the exhaust camshaft 16 has two low lift side cams 25 and 27 and one high lift center cam 26 for each exhaust valve 40. The low lift side cams 25 and 27 have the same shape of lobes. The high lift center cam 26 has a lobe different in shape from those of the low lift side cams 25 and 27 and is interposed between the low lift side cams 25 and 27. The cam lobe of high lift center cam 26 is in contact with a center portion of the tappet assembly 24 (which is hereafter referred to as a center tappet 41 and will be described in detail later) The cam lobes of low lift side cams 25 and 27 are in contact with opposite side portions of the tappet assembly 24 (which are hereafter referred to as side tappets 42 and will be described in detail later) at opposite sides of the center portion. The low lift side cam 25, 27 has a lobe lower than that of the high lift center cam 26.

The cylinder head 12 comprises a base portion 30 and front side, rear end and rear side shrouds 31, 32 and 33 extending vertically from the front side, rear end and rear side peripheries of the base portion 30. The front side, rear end and rear side shrouds 31, 32 and 33 are formed as a continuous wall. The engine 1 has a front cover 28 that covers front ends of the cylinder block 11, the cylinder head 12 and the head cover 13 so as to protect a camshaft drive mechanism including the crankshaft pulley 17 the camshaft pulleys 18 and 19, the tension pulley 20, the idle pulley 21 and the timing belt 22. The cylinder head 12 is formed with an upper portion of combustion chamber B, the intake ports 34, the exhaust ports 35 and a plug hole 36 per cylinder all of which are bored in the cylinder head base portion 30. The cylinder head 12 at opposite sides is provided with an intake manifold 37 and an exhaust manifold 38 mounted to the cylinder head base portion 30.

There is a cam carrier 50 on the cylinder head base portion 30. The cam carrier 50 comprises a horizontal base plate 51 disposed in a space that is formed over the cylinder head base portion 30 by the continuous shrouds 31, 32 and 33 and a peripheral shroud 52 extending along the almost entire periphery of the horizontal base plate 51 such as to provide a box-shaped configuration. Journal bearings 57 are located such that the journal bearings 57 are on each of the opposite sides of a straight row of the cylinder 2 as viewed in the longitudinal direction of the vehicle body and that there is one journal bearing 57 per camshaft behind each cylinder A as viewed in the transverse direction of the vehicle body. The journal bearings 57 support the intake camshaft 15 and the exhaust cam shaft 16 at their journals 15*a* and 16*a*, respectively, for rotation. The journal bearing 57 comprises a bearing lower block 53 formed as an integral part of the horizontal base plate 51 and a bearing upper block 55 secured to the bearing lower block 53 by fastening bolts 56 and 56*a*. The each pair of bearing lower blocks 53 for the intake camshaft 15 and the exhaust camshaft 16 are interconnected by a bridge 72 formed as an integral part of the horizontal base plate 51. In this instance, the journal bearings 57 are basically identical in configuration and arranged at regular intervals. However, the foremost journal bearings 57*a* are slightly different in configuration from the remaining journal bearings 57 and located closely to the camshaft pulleys 18 and 19, respectively.

There is one tappet guide 54 formed in the horizontal base plate 51 per cylinder in which the tappet assembly 24 is received for slide movement therein. The tappet guide 54 is such an inclined cylindrical bore as to extend through the horizontal base plate 51. The tappet assembly 24 slides up and down in the tappet guide 54 following rotation of the cams 25–27 so as to lift up and down the intake valve 39 or the exhaust valve 40. There is further a guide bore 58 formed in the horizontal base plate 51 as a guide way for the spark plug 23 when the spark plug 23 is fixedly mounted in the plug hole 36. Specifically, the spark plug guide bore 58, except the foremost one, is formed such as to pass through a cylindrical column 59 vertically extending above the center of each cylinder 2 from the horizontal base plate 51. As seen in FIG. 2, the spark plug guide bore 58 associated with the foremost cylinder 2 is formed in a cocoon-shaped column 62. A bore 61 is also formed in the column 61 so as to receive a hydraulic oil supply control valve 60 operative to supply hydraulic oil to the tappet assembly 24.

The head cover 13 is brought into contact with the cylinder head 12 along the top surfaces of shrouds 13–33 extending vertically from the base portion 30.and the top surfaces of the columns 59 and 62 vertically extending from the horizontal base plate 51 and fixedly attached to the cylinder head 12. The horizontal base plate 51 has ribs 63 and 64 extending in a direction from the front end to the rear end of the engine 1. The rib 63, which is formed as an integral part of the horizontal base plate 51, is located between a straight row of the tappet guide 54 associated with the intake camshaft 15 and a straight row of spark plug guide bores 58 and extends in parallel to the intake camshaft 15 in a direction from the front to the back of the engine 1. An oil gallery 65 is formed in the rib 63. Similarly, the rib 63, which is formed as an integral part of the horizontal base plate 51, is located between a straight row of the tappet guide 54 associated with the exhaust camshaft 16 and the straight row of spark plug guide bores 58 and extends in parallel to the exhaust camshaft 16 in a direction from the front to the back of the engine 1. An oil gallery 66 is formed in the rib 64.

Figure 3:
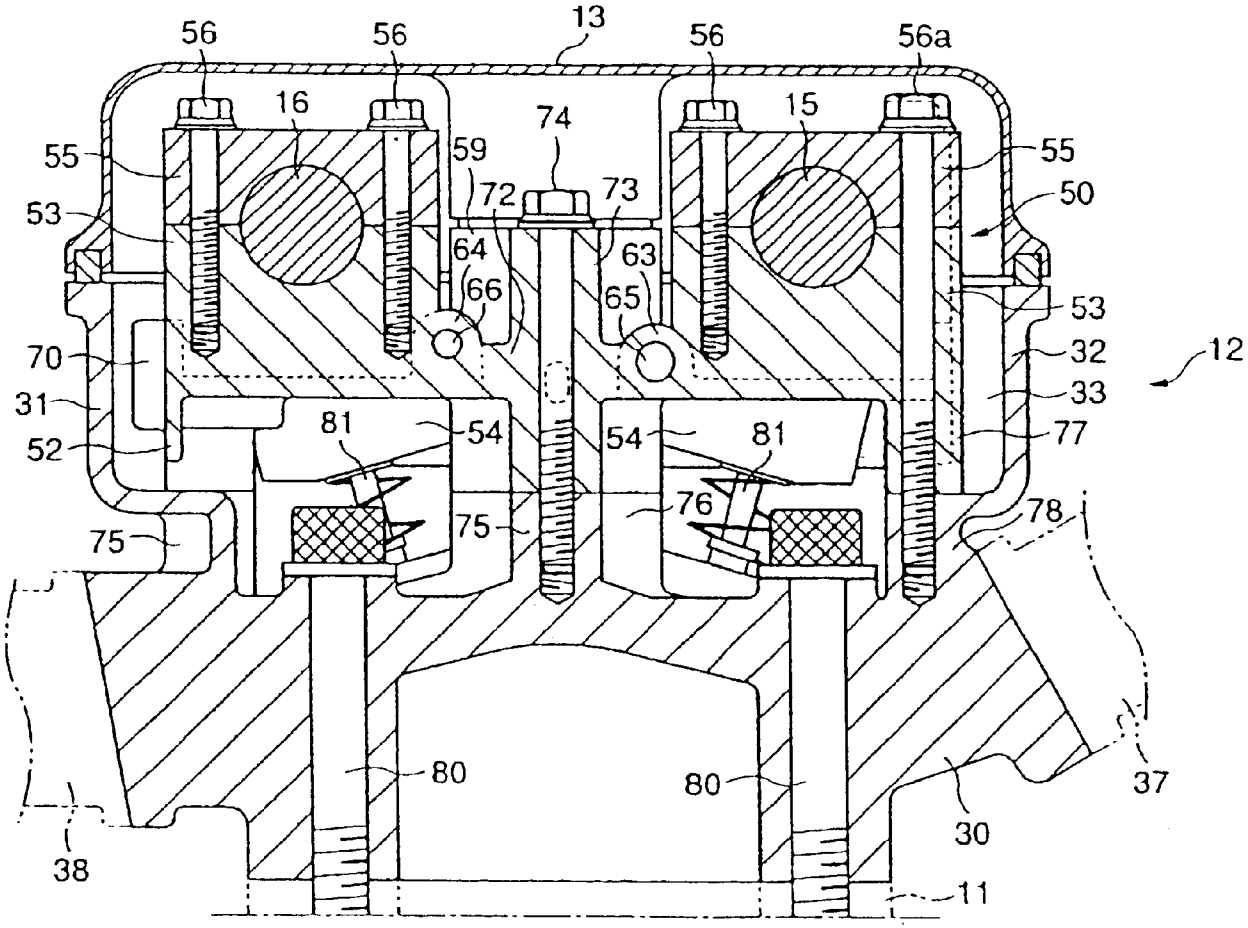
FIG. 3 is a cross-sectional view of the engine taken along line III—III of FIG. 2.
Figure 4:
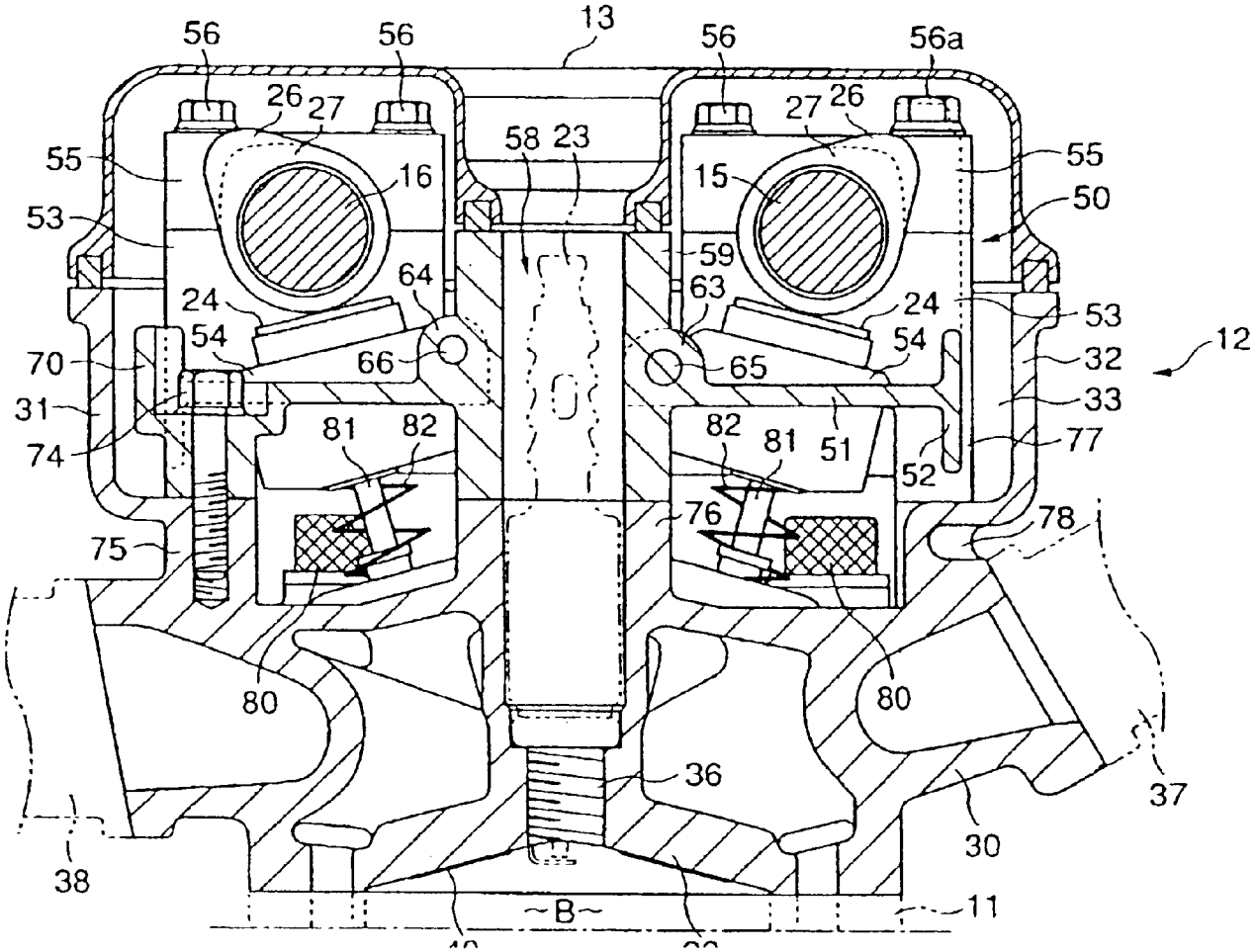
FIG. 4 is a cross-sectional view of the engine take n along line IV—IV of FIG. 2.
Figure 5:
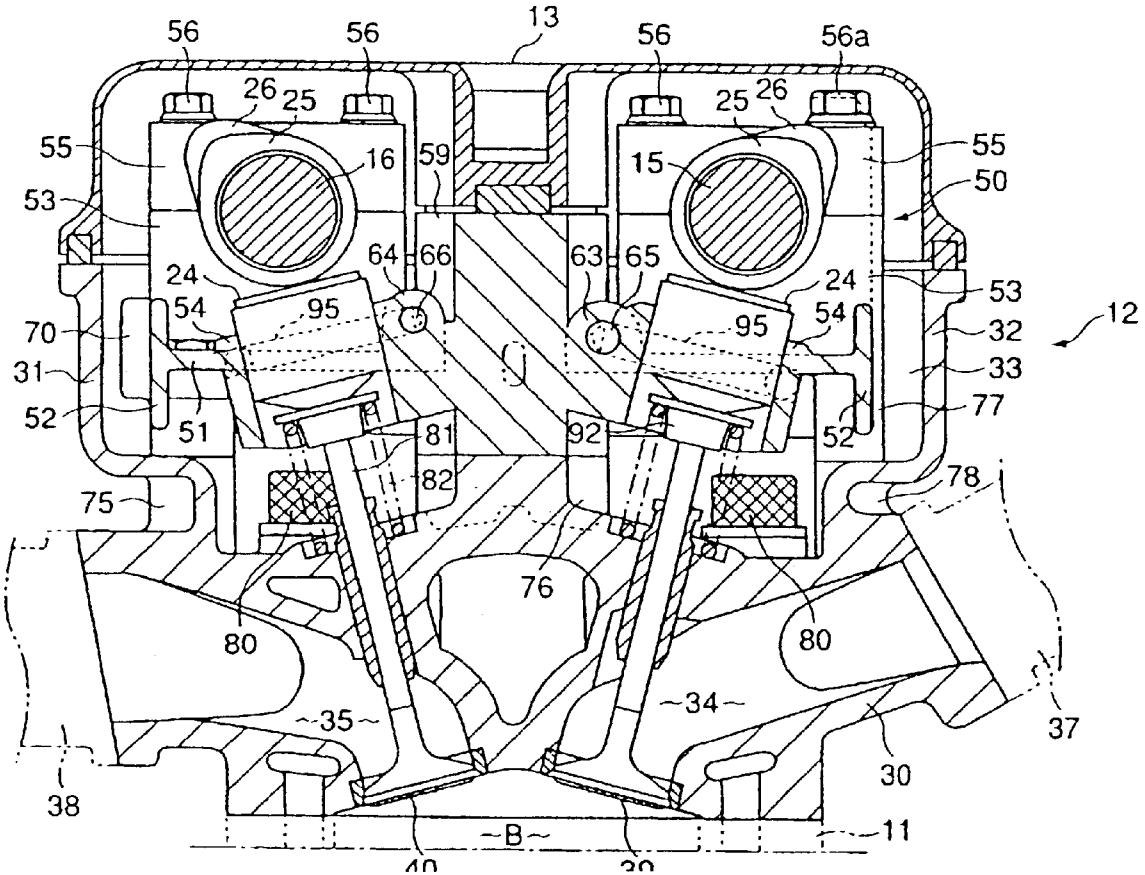
FIG. 5 is a cross-sectional view of the engine taken along line V—V of FIG. 2.

As clearly shown in FIG. 3, the horizontal base plate 51 is formed with a plurality of circular-shaped recesses 70 at the front side thereof and a plurality of circular-shaped projections 71 (see FIG. 2) at the rear side thereof. Further, the horizontal base plate 51 has a cylindrical column 72 with a through bore 73 formed at the center thereof. The cylinder head 12 has cylindrical columns 75 correspondingly in position to the circular-shaped recesses 70, circular-shaped projections 71 and bridge 73. In securing the cam carrier 50 to the cylinder head 12, the cam carrier 50 is placed on the cylinder head 12 by bringing these circular-shaped recesses 70, circular-shaped projections 71 and bridge 73 into contact with the columns 75, respectively and then fixedly secured to the cylinder head 12 by fastening bolts 74 into the columns 75. The cylinder head 12 at the base portion 30 has further cylindrical columns 76 correspondingly in position to the columns 59 and 62 of the cam carrier 50. These cylindrical columns 76 are such that, when the cam carrier 50 is secured to the cylinder head 12, the columns 76 are abutted by the columns 59 and 62 of the cam carrier 50. This is advantageous to stably fix the cam carrier 50 to the cylinder head 12.

Some of the fastening bolts 56, namely the fastening bolts 56*a* that are used to fixedly secure the bearing upper block 55 to the bearing lower block 53 for supporting the intake camshaft 15, are sufficiently long in length differently from the remaining fastening bolts 56 so as to extend passing through both bearing lower block 53 and horizontal base plate 51, thereby fixedly securing the cam carrier 50 to the cylinder head 12 while fixedly securing the bearing upper block 55 to the bearing lower block 53. In this instance, the cam carrier 50 has cylindrical columns 77 extending downward from the horizontal base plate 51 at locations corresponding to these fastening bolts 56*a,* and the cylinder head 12 is formed with cylindrical columns 78 extending upward from the cylinder head base portion 30 as counterparts of the cylindrical columns 77. When the cam carrier 50 is secured to the cylinder head 12, the cylindrical columns 78 of the cylinder head 12 are abutted by the cylindrical columns 77 of the cam carrier 50. This is advantageous to stably fix the cam carrier 50 to the cylinder head 12.

As clearly shown in FIG. 3, the cylinder head 12 is fixedly secured to the cylinder block 11 by fastening bolts 80. The fastening bolts 80 are located such that the fastening bolts 80 are on each of the opposite sides of the straight row of the cylinder 2 as viewed in the longitudinal direction of the vehicle body and that there is one fastening bolt 80 per camshaft behind each cylinder 2 as viewed in the transverse direction of the vehicle body. This arrangement of fastening bolts 80 causes the fastening bolts 80 receive explosion force generated in the respective cylinders 1 equally.

As described above, in the structure associated with camshaft drive mechanism, the cam carrier 50, that is provided separately from the cylinder head 12, has the bearing lower blocks 53 forming part of the journal bearings 57 and the tappet guides 54. This structure enables the bearing lower blocks 53 of the journal bearings 57 and the tappet guides 54 to be assembled to the cylinder head 12 all at once by fixing the cam carrier 50 to the cylinder head 12 only, so as to prevent aggravation of assembling performance and serviceability of the engine 1 that is caused due to possible mechanical interference between the fastening bolts 80 and the camshafts 15 and 16. In addition, this structure provides significant improvement of layout and, as a result of which, the cylinder head 12 is improved in assembling performance and enabled to be compact. The cam carrier 50 is constructed by means of mutual combinations of various parts stretching or extending in different directions such as the horizontal base plate 51, the peripheral shroud 52, the bearing lower block 53, the tappet guides 54 and the like and, in consequence, these parts are complementary to each other. As a result, the cam carrier 50 is given a high stiffness and leads to stable support of the camshafts 15 and 16, the tappet assemblies 24 and the hydraulic oil supply control valve 60. Further, because the cam carrier 50 is provided separately from the cylinder head 12, there occurs no possible mechanical interference between the fastening bolts 80 and the bearings 57 comprising the upper and lower bearing blocks 53 and 55, so that the layout of bolts 80 causes no constraints on the degree of freedom in arranging the bearings 57. This permits both of the bearing 57 and the fastening bolt 80 to clash in position with each other such that they are located in an intermediate position between two adjacent cylinders B on one of the opposite sides of a straight row of the cylinder A as viewed in the lengthwise direction of the vehicle body.

Figure 6:
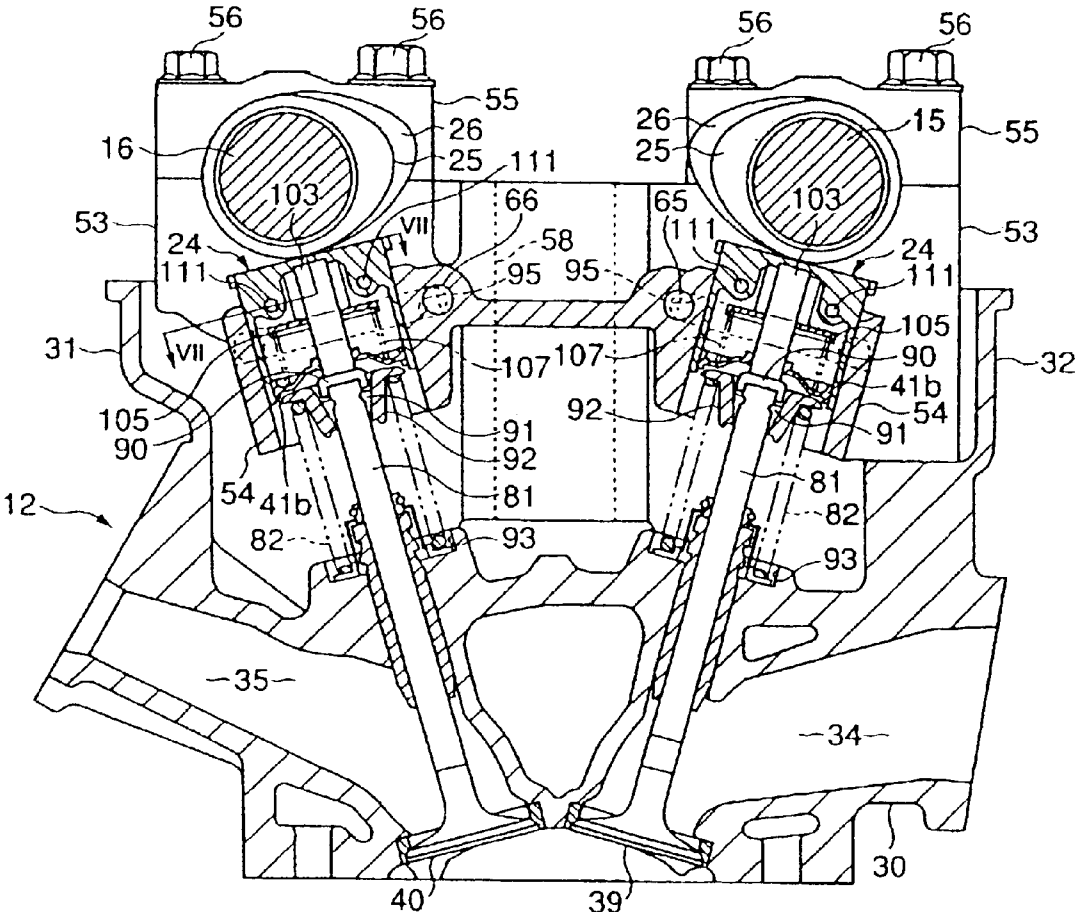
FIG. 6 is a cross-sectional view of an tappet assembly of the valve drive mechanism.
Figure 7:
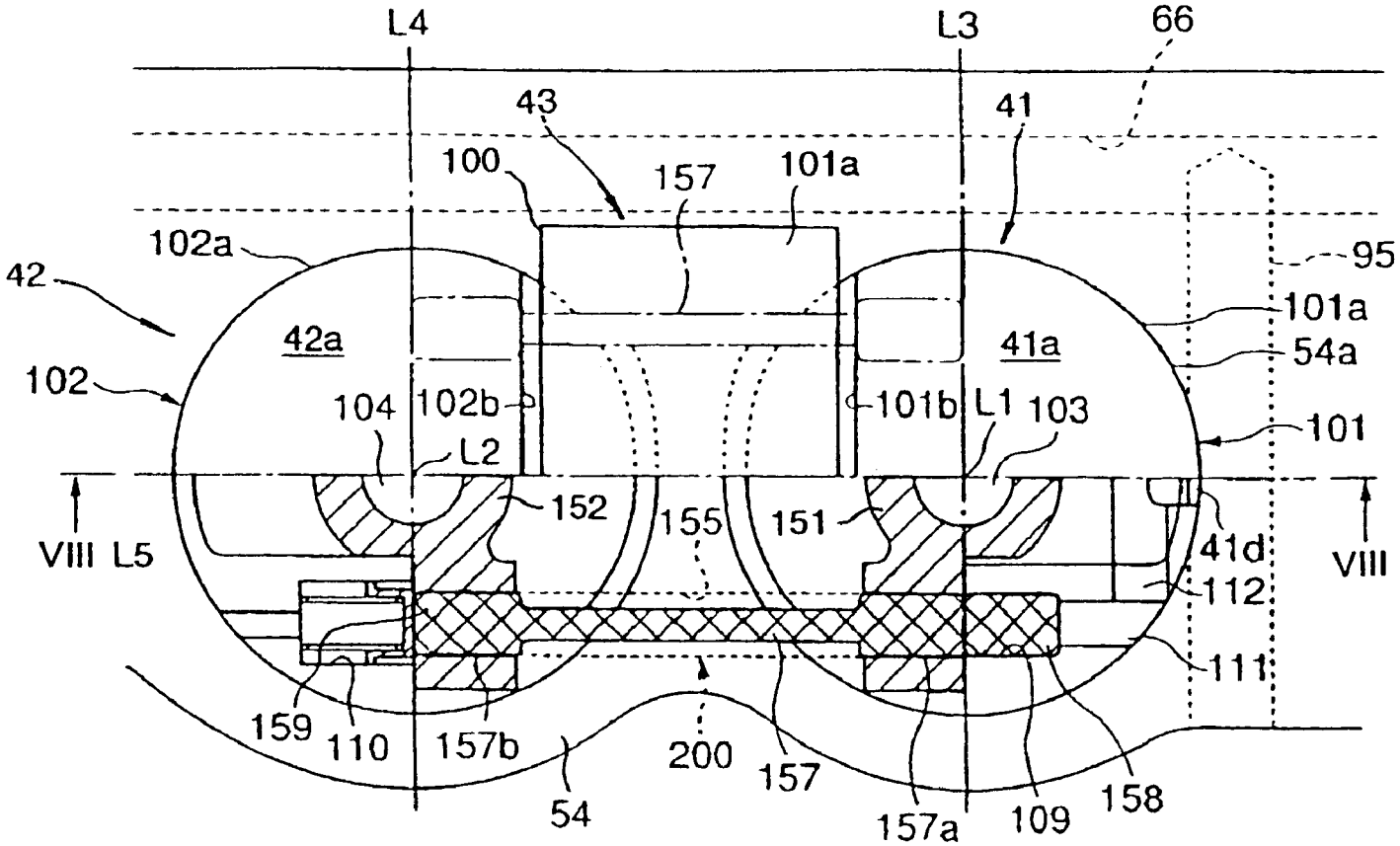
FIG. 7 is a schematic sectional view of the tappet assembly taken along line VII—VII of FIG. 6.
Figure 8:
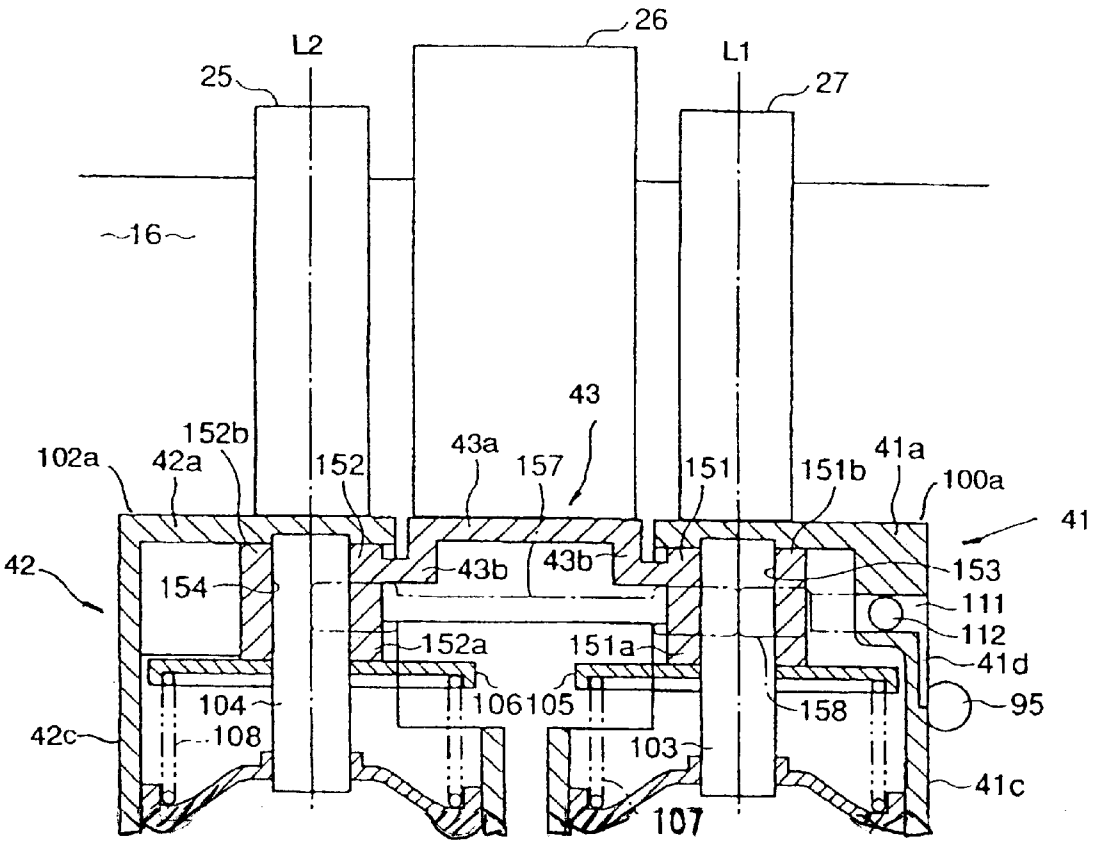
FIG. 8 is a schematic sectional view of the tappet assembly taken along line VIII—VIII of FIG. 7.

FIGS. 6 to 8 show the tappet assembly 24 in detail. It is to be noted that the intake valves 39 and the exhaust valves 40 are symmetrical in position with respect to the center vertical axis of the cylinder A and identical in structure and that, while the same tapped assembly 24 is installed to each of valve trains for the intake valves 39 and the exhaust valves 40, respectively, in this embodiment, it may be installed either one of the valve trains of the intake valves 39 and exhaust valves 40.

As shown in FIGS. 6 to 8, the tappet assembly 24 is almost touched by upper ends of the valve stems 81 of two valves, the intake valves 39 or the exhaust valves 40, through shims 90. The tappet assembly 24 has a valve stem seat 92. On the other hand, the cylinder head 12 has an annular recess 93 per valve stem. A valve spring 82 is mounted on the valve stem 81 between the valve stem seat 92 and the annular recess 93 of the cylinder head 12 so as to force the tappet assembly 24 against the cam lobe of the cams 25–27 of the camshaft 15, 16, in other words to force the valve 39, 40 to remain closed. Denoted by 91 in FIG. 6 is a cotter or lock groove.

There is a branch oil channel 95 branching off from the oil gallery 65 at a right angle near the tappet guide 54 in the cylinder head 12. Similarly, there is a branch oil channel 95 branching off from the oil gallery 66 at a right angle near the tappet guide 54 in the cylinder head 12. These oil galleries 65 and 66 extend in parallel with the camshafts 15 and 16, respectively. The branch oil channel 95 is formed by drilling a channel in the cylinder head 12 until reaching the oil gallery 65 or 66.

The tappet assembly 24 comprises two side tappets 41 and 42 and a center tappet 43 interposed between the side tappets 41 and 42. The valve stems 81 of the valve 39, 40 that are simultaneously driven are attached to the side tappets 41 and 42, respectively. The center tappet 43 is movable relatively to the side tappets 41 and 42. There is a pair of locking/unlocking mechanisms 200 between the center tappet 43 and the side tappets 41 and 42 in the tappet assembly 24. The locking/unlocking mechanism 200 operates to mechanically couple the center tappet 43 to the side tappets 41 and 42 together and to uncouple them from each other so as to allow the center tappet 43 to move relatively to the side tappets 41 and 42.

Each low lift side cam 25, 27 has a cam profile for low lift or low speed operation. The high lift center cam 26 has a cam profile for high lift or high speed operation. Accordingly, the low lift side cam 25, 27 has a lobe lower than the high lift center cam 26. The locking/unlocking mechanisms 200 are disposed on opposite sides of the camshaft 15, 16 along lines parallel to but offset in rotational directions of the cams 25–27 from a center line L5 passing vertical center axes L1 and L2 of the side tappets 41 and 42 and perpendicular to horizontal center lines L3 and L4 in rotational directions of the low lift side cams 25 and 27, respectively.

Figure 9A:
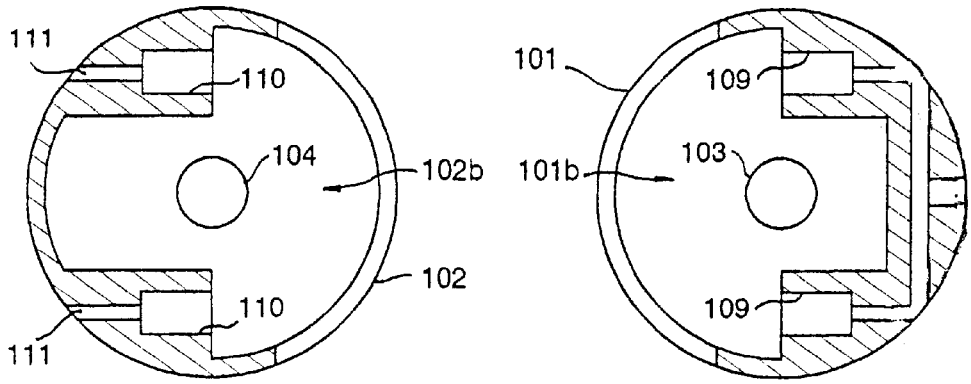
FIG. 9A is a cross-sectional view of hollow shells of adjacent side tappets.
Figure 9B:
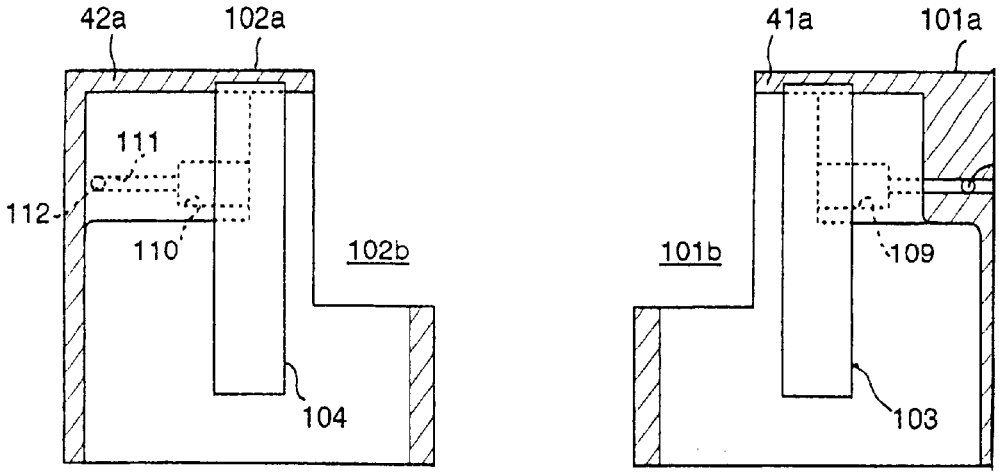
FIG. 9B is a vertical cross-sectional view of the hollow shells of the adjacent side tappets.
Figure 9C:
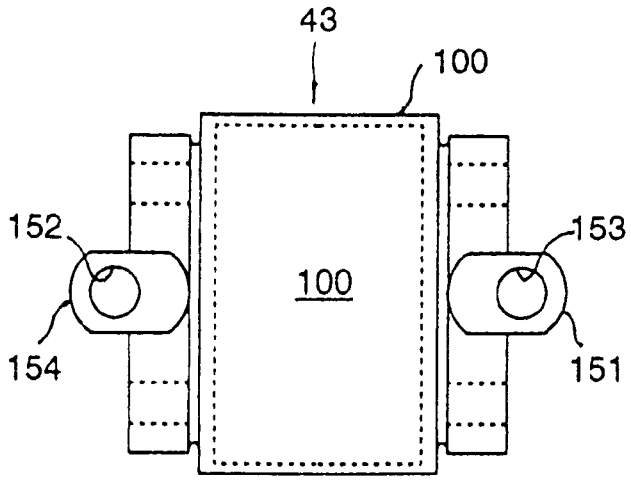
FIG. 9C is a top view of a center tappet.
Figure 9D:
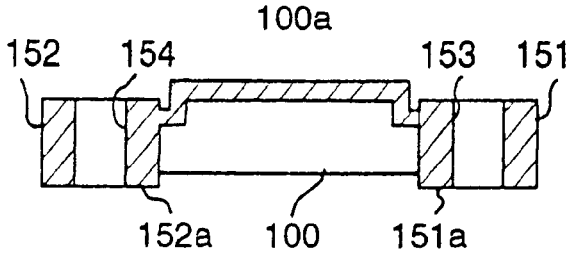
FIG. 9D is a vertical cross-sectional view of the side tappet.

As shown in detail in FIGS. 9A and 9B, the side tappets 41 and 42 are apart by a specified distance in a rotational axis of camshaft. Each side tappet 41, 42 comprises a generally cylindrically shaped hollow shell 101, 102. The side tappet 41 has a rectangular opening 101*b* formed in the hollow shell 101 so as to face the hollow shell 102 of the side tappet 42. Similarly, the side tappet 42 has a rectangular opening 102*b* formed in the hollow shell 102 so as to face the hollow shell 101 of the side tappet 41. The side tappet 41 is provided with a guide rod 103 which is secured to a top wall 41*a* of the hollow shall 101 forming a tappet head 101*a* and extends coaxially with the vertical center axis L1 between the top wall 41*a* and a bottom wall 41*b*. Similarly, The side tappet 42 is provided with a guide rod 104 which is secured to a top wall 42*a* of the hollow shall 102 forming a tappet head 102*a* and extends coaxially with the vertical center axis L2 between the top wall 42*a* and a bottom wall 42*b*. As shown in detail in FIGS. 9C and 9D, the center tappet 43 that is received in the rectangular openings 101*b* and 102*b* of the side tappets 41 and 42 and is guided for up and down slide movement by the guide rods 103 and 104 comprises a generally box-shaped shell 100 opened at the bottom and guide arms 151 and 152 extending in opposite directions from the box-shaped shell 100 to the guide rods 103 and 104 of the side tappets 41 and 42, respectively. These guide arms 151 and 152 are formed with guide bores 153 and 154, respectively, which receive the guide rods 103 and 104 of the side tappets 41 and 42, respectively, therein.

As seen in FIG. 8, the side tappet 41 is provided with a spring retainer 105 that is mounted on the guide rod 103 and is abutted by the guide arm 151 of the center tappet 43 at its lower end 151*a* and a tappet spring 107 which is disposed between the spring retainer 105 and the bottom wall 41*b*. Similarly, the side tappet 42 is provided with a spring retainer 106 mounted on the guide rod 104 and abutted by the guide arm 152 of the center tappet 43 at its lower end 152*a* and a tappet spring 108 mounted on the guide rod 104 between the spring retainer 106 and the bottom wall 42*b*. The tappet springs 107 and 108 always force the center tappet 43 upward along the guide rods 103 and 104 so as to bring the arms 151 and 152 of the center tappet 43 into abutment against under surfaces of the top walls 41*a* and 42*a* of the side tappets 41 and 42, respectively. While the center tappet 53 at the arms 151 and 152 remains in abutment with the top walls 41 a and 42*a* of the side tappets 41 and 42, the center tappet 43 and the side tappets 41 and 42 place their tappet head surface substantially even with one another. The center tappet 43 has a rectangular tappet head 100*a* (see FIG. 9C) extending in a rotational direction of the high lift center cam 26.

The locking/unlocking mechanisms 200, identical in structure and operation, are disposed on opposite sides of the camshaft 16 along the lines offset in the rotational directions of the cams 25–27 from the center line L5 passing the vertical center axes L1 and L2 of the side tappets 41 and 42. Each locking/unlocking mechanisms 200 comprises a locking/unlocking pin 157 having opposite end portions 157*a* and 157*b* enlarged in diameter, a hydraulically operated locking plunger 158 having the same diameter as the opposite end portions 157*a* and 157*b*, and a spring loaded unlocking receiver 159. There are formed through guide gores 155, 109 and 110 in alignment with one another in the center tappet 43 and the side tappets 41 and 42, respectively. The locking/unlocking pin 157 has the same length as the guide bore 155 of the center tappet 43 and is received at the opposite end portions 157*a* and 157*b* for slide movement in the guide bore 155. The hydraulically operated locking plunger 158 is received for slide movement in the guide bore 109 of the side bore 109. The spring loaded unlocking receiver 159 is received in the guide bore 110 of the side tappet 42. This spring loaded unloaded receiver 159 is restricted in movement toward the center tappet 43 such that, when the spring loaded unlocking receiver 159 is in its one of extreme positions, it is even with the interface between the center tappet 43 and the side tappet 42. The guide bore 109 of the side tappet 41 is formed with an oil chamber 111 in communication with an oil channel 112 formed in the side tappet 41. There is a vertical oil channel 41*d* formed in an outer wall 41*c* of the side tappet 41 so as to communicate the oil channel 112 with the branch oil channel 95. The vertical oil channel 41*d* has a length sufficient to always keep communication of the oil channel 112 with the branch oil channel 95 during up and down movement of the side tappet 41.

Locking operation of the locking/unlocking mechanisms 200 is such that, when a hydraulic oil is introduced into the oil chamber 111 through the oil channel 112, the hydraulically operated locking plunger 158 is forced to partly enter the guide bore 155 of the center tappet 43 pushing the locking/unlocking pin 157 against the spring loaded unlocking spring 159 so that the locking/unlocking pin 157 at the end portion 157*b* partly enters the guide bore 110 of the side tappet 42. As a result, the locking/unlocking mechanism 200 mechanically couples the center tappet 43 to both side tappets 41 and 42 together, in other words locks the tappet assembly 24. On the other hand, unlocking operation of the locking/unlocking mechanisms 200 is such that, when the hydraulic oil in the oil chamber 111 is reduced, the locking/unlocking pin 157 is forced by the spring loaded unlocking receiver 159 to slide in the guide bore 155 pushing the hydraulically operated locking plunger 158 so that the locking/unlocking pin 157 at the end portion 157*b* comes out of the guide bore 110 of the side tappet 42 and the hydraulically operated locking plunger 158 also comes out of the guide bore 155 of the center tappet 43 and then completely returns into the guide bore 109 of the side tappet 41. As a result, the locking/unlocking mechanism 200 mechanically uncouples the center tappet 43 from both side tappets 41 and 42, in other words unlocks the tappet assembly 24.

In this instance, the oil chamber 111 and the oil channel 112 are formed by drilling the side tappet 41 such that they intersect at a position on a periphery of the side tappet 41. This makes it certain that the oil channel and port are open at less locations. This is advantageous to reducing pressure relief openings as less as possible and, in consequence to providing necessary hydraulic oil for the hydraulically operated locking plunger 158. Further, the branch oil channel 95 is formed by drilling the base portion 30 of the cylinder head 12 from the side shroud, 31, 32 toward the oil gallery 65, 66 after forming the cylinder head 12 such as to partly overlap the inner wall 54*a* of the tappet guide 54 so as to be placed in communication with the vertical oil channel 41*d* of the side tappet 41 when the tappet assembly 24 is installed to the cylinder head 12.

In operation of the valve drive mechanism equipped with the tappet assembly 24, when it is intended to drive the valve 39, 40 for low lift operation for low speed engine operation, the hydraulic oil supply control valve 60 is operated to remove or reduce hydraulic oil from the oil chamber 111 of the side tappet 42. The locking/unlocking pin 157, and hence the hydraulically operated locking plunger 158, is pushed back in the axial direction of camshaft by the spring loaded unlocking receiver 159 until the locking/unlocking pin 157 at the end portion 157*b* comes out of the guide bore 110 of the side tappet 42 and is completely received in the guide bore 155 of the center tappet 43 and, the hydraulically operated locking plunger 158 comes out of the guide bore 155 of the center tappet 43 and completely returns into the guide bore 109 of the side tappet 41 consequently. As a result, the locking/unlocking pin 157 unlocks the tappet assembly 24 or uncouples the center tappet 43 from both of the side tappets 41 and 42, then, the center tappet 43 is allowed to slide up and down relatively to the side tappets 41 and 42. When the valve drive mechanism is operated, while the side tappets 41 and 42 are reciprocally moved up and down by the low lift side cams 25 and 27, respectively, the center tappet 43 is moved up and down independently from the side tappets 41 and 42 by the high lift center cam 26. Therefore the valve is 39, 40 is driven by the low lift side cams 25 and 27.

On the other hand, when it is intended to drive the valve 39, 40 for high lift operation for high speed engine operation, the hydraulic oil supply control valve 60 is operated to introduce or increase hydraulic oil in the oil chamber 111 of the side tappet 42 through the oil channel 112. The hydraulically operated locking plunger 158, and hence the locking/unlocking pin 157, is forced in the axial direction of camshaft against the spring loaded unlocking receiver 159 until the hydraulically operated locking plunger 158 partly enters the guide bore 155 of the center tappet 43 and the locking/unlocking pin 157 at the end portion 157*b* partly enters the guide bore 110 of the side tappet 42, consequently. As a result, the locking/unlocking pin 157 locks the tappet assembly 24 or couples the center tappet 43 to both of the side tappets 41 and 42, then, the tappet assembly 24 moves up and down as one whole. When the valve drive mechanism is operated, the tappet assembly 24, i.e. the center tappet 43 and both side tappets 41 and 42, is reciprocally moved up and down by the high lift side cams 25 and 27. Therefore the valve is 39, 40 is driven by the high lift center cam 26.

It is to be understood that although the present invention has been described in detail with regard to preferred embodiments thereof, various other embodiments and variants may occur to those skilled in the art, which are within the scope and spirit of the invention, and such embodiments and variants are intended to be covered by the following claims.

What is claimed is:

1. A valve drive mechanism for an engine having twin intake valves and twin exhaust valves per cylinder for driving simultaneously each said twin valve by one center cam on a camshaft and a pair of side cams on said camshaft that are arranged on opposite sides of said center cam in an axial direction of said camshaft and different in cam profile from said center cam, said valve drive mechanism comprising:

one center tappet having a generally rectangular tappet head and operative to transmit rotation of said center cam as reciprocating movement to said twin valves;

a pair of side tappets, between which said center tappet is interposed so as to move relatively to said side tappets in a direction of valve lift, operative to transmit rotation of said side cams as reciprocating movement to said twin valves through valve stems, respectively; and a locking/unlocking mechanism operative to mechanically couple and uncouple said center tappet and said side tappets in locking/unlocking positions each of which is in a vertical plane including a substantial center axis of each said side tappet and intersecting perpendicularly to said axial direction of said camshaft so as thereby to selectively transmit said rotation of said center cam and said side cams as reciprocal movement to said twin valves, the locking/unlocking mechanism being disposed on each of opposite sides of said camshaft and offset from a line passing said substantial center axis in a rotational direction of said camshaft.

2. A valve drive mechanism as defined in claim 1, wherein said center cam has a cam profile for high lift operation and each said side cam has a cam profile for low lift operation which is lower in valve lift than said high lift operation.

3. A valve drive mechanism as defined in claim 1, wherein said side tappets have generally cylindrical hollow shells formed with rectangular openings, respectively, and are disposed at a specified distance from each other in said axial direction of said camshaft so as to receive said center tappet in said rectangular openings.

4. A valve drive mechanism as defined in claim 3, wherein said center cam has a cam profile for high lift operation and each said side cam has a cam profile for low lift operation which is lower in valve lift than said high lift operation.

5. A valve drive mechanism as defined in claim 3, wherein locking/unlocking mechanism further comprises an oil channel formed in said one side tappet through which said hydraulic oil is introduced into said first guide bore.

6. A valve drive mechanism as defined in claim 5, wherein said locking/unlocking mechanism further comprises a branch oil channel formed in a tappet guide for said one side tappet so as to communicate said oil channel with an oil gallery formed in parallel to said camshaft in a cylinder head, said branch oil channel partly opening to a tappet guide bore of said tappet guide in which said one side tappet is received so as to communicate said tappet guide bore with said branch oil passage.

7. A valve drive mechanism as defined in claim 6, wherein said locking/unlocking mechanism further comprises a vertical oil channel formed in said one side tappet so as to communicate both said oil channels of said locking/unlocking mechanisms, said vertical oil channel having a length in said direction of valve lift sufficient to keep communication of both said oil channels of said locking/unlocking mechanisms with said branch oil channel while said tappet assembly reciprocally moves in said direction of valve lift.

8. A valve drive mechanism as defined in claim 7, wherein said locking/unlocking mechanism further comprises an oil chamber formed at one of opposite ends of said first guide bore in said one side tappet, said oil chamber extending coaxially with said first guide bore from said first guide bore to an outer wall of said one side tappet.

9. A valve drive mechanism as defined in claim 8, wherein said vertical oil channel extends in a direction perpendicularly to a line passing both said substantial center axes of said side tappet and is in communication with said branch oil channel at a location where said branch oil channel partly opens to said tappet guide bore of said tappet guide.

10. A valve drive mechanism as defined in claim 1, and further comprising spring means for forcing said center tappet to keep slide contact with said center cam, wherein each said locking/unlocking mechanism comprises a locking/unlocking pin movably received in a center guide bore which is formed in said center tappet so as to extend along a line which is offset from said substantial center axis in a rotational direction of said camshaft and is in parallel to said camshaft between said planes, a hydraulically operated locking plunger movably received in a first guide bore which is formed in alignment with said center guide bore in one of said side tappets, and a spring loaded unlocking receiver movably received in a second guide bore which is formed in alignment with said center guide bore in another one of said side tappets, said locking/unlocking pin being forced to partly enter said second guide bore by said hydraulically operated locking plunger when said hydraulically operated locking plunger is forced by hydraulic oil to partly enter said center guide bore so as to mechanically couple said center tappet to said side tappets and being forced by said spring loaded unlocking receiver to come out of said second guide bore and to return said hydraulically operated locking plunger into said first guide bore when said hydraulically operated locking plunger is released from said hydraulic oil.

11. A valve drive mechanism for an engine having twin intake valves and twin exhaust valves per cylinder for driving simultaneously each said twin valve by one center cam on a camshaft and a pair of side cams on said camshaft that are arranged on opposite sides of said center cam in an axial direction of said camshaft and different in cam profile from said center cam, said valve drive mechanism comprising:

one center tappet operative to transmit rotation of said center cam as reciprocating movement to said twin valves;

a pair of side tappets, between which said center tappet is interposed so as to move relatively to said side tappets in a direction of valve lift, operative to transmit rotation of said side cams as reciprocating movement to said twin valves through valve stems, respectively;

a locking/unlocking mechanism operative to mechanically couple and uncouple said center tappet and said side tappets in locking/unlocking positions each of which is in a vertical plane including a substantial center axis of each said side tappet and intersecting perpendicularly to said axial direction of said camshaft so as thereby to selectively transmit said rotation of said center cam and said side cams as reciprocal movement to said twin valves; and a pair of guide rods disposed in said side tappets, respectively, coaxially with said substantial vertical center axes of said side tappets, respectively, by which said center tappet is supported for slide movement.

12. A valve drive mechanism as defined in claim 11, wherein said center tappet has a generally rectangular tappet head and said locking/unlocking mechanism is disposed on each of opposite sides of said camshaft and offset from a line passing said substantial vertical center axis in a rotational direction of said camshaft.

13. A valve drive mechanism as defined in claim 12, wherein said side tappets have generally cylindrical hollow shells formed with rectangular openings, respectively, and are disposed at a specified distance from each other in said axial direction of said camshaft so as to receive said center tappet in said rectangular openings.

14. A valve drive mechanism as defined in claim 13, wherein said center cam has a cam profile for high lift operation and each said side cam has a cam profile for low lift operation which is lower in valve lift than said high lift operation.

15. A valve drive mechanism as defined in claim 12, and further comprising spring means for forcing said center tappet to keep slide contact with said center cam, wherein each said locking/unlocking mechanism comprises a locking/unlocking pin movably received in a center guide bore which is formed in said center tappet so as to extend along a line which is offset from said substantial vertical center axis in a rotational direction of said camshaft and is in parallel to said camshaft between said planes, a hydraulically operated locking plunger movably received in a first guide bore which is formed in alignment with said center guide bore in one of said side tappets, a spring loaded unlocking receiver movably received in a second guide bore which is formed in alignment with said center guide bore in another one of said side tappets, said locking/unlocking pin being forced to partly enter said second guide bore by said hydraulically operated locking plunger when said hydraulically operated locking plunger is forced by hydraulic oil to partly enter said center guide bore so as to mechanically couple said center tappet to said side tappets and being forced by said spring loaded unlocking receiver to come out of said second guide bore and to return said hydraulically operated locking plunger into said first guide bore when said hydraulically operated locking plunger is released from said hydraulic oil.

16. A valve drive mechanism as defined in claim 15, wherein locking/unlocking mechanism further comprises an oil channel formed in said one side tappet through which said hydraulic oil is introduced into said first guide bore.

17. A valve drive mechanism as defined in claim 16, wherein said locking/unlocking mechanism further comprises a branch oil channel formed in said one side tappet so as to communicate said oil channel with an oil gallery formed in parallel to said camshaft in a cylinder head, said branch oil channel partly opening to a tappet guide bore of said tappet guide in which said one side tappet is received so as to communicate said tappet guide bore with said branch oil passage.

18. A valve drive mechanism as defined in claim 17, wherein said locking/unlocking mechanism further comprises a vertical oil channel formed in said one side tappet so as to communicate both said oil channels of said locking/unlocking mechanisms, said vertical oil channel having a length in said direction of valve lift sufficient to keep communication of both said oil channels of said locking/ unlocking mechanisms with said branch oil channel while said tappet assembly reciprocally moves in said direction of valve lift.

19. A valve drive mechanism as defined in claim 18, wherein said locking/unlocking mechanism further comprises an oil chamber formed at one of opposite ends of said first guide bore in said one side tappet, said oil chamber extending coaxially with said first guide bore from said first guide bore to an outer wall of said one side tappet.

20. A valve drive mechanism as defined in claim 19, wherein said vertical oil channel extends in a direction perpendicularly to a line passing both said substantial vertical center axes of said side tappet and is in communication with said branch oil channel at a location where said branch oil channel partly opens to said tappet guide bore of said tappet guide.

* * * * *